US005546830A

United States Patent [19]

Yuen

[11] Patent Number: 5,546,830

[45] Date of Patent: Aug. 20, 1996

[54] INK CARTRIDGE OPENER

[76] Inventor: Kenneth H. Yuen, 1613 Chelsea Rd., San Marino, Calif. 91108

[21] Appl. No.: 233,359

[22] Filed: Apr. 26, 1994

[51] Int. Cl.[6] ..... B67B 7/92

[52] U.S. Cl. ..... 81/3.39; 225/96.5; 225/103

[58] Field of Search ..... 225/93, 96.5, 103; 81/3.27, 3.37, 3.39, 3.55; 254/104, 113, 120, 131; 29/801, 239

[56] References Cited

U.S. PATENT DOCUMENTS

| | | | |
|---|---|---|---|
| 1,376,994 | 5/1921 | Arnold | 81/3.27 |
| 2,386,460 | 10/1945 | Heim | 81/3.39 X |
| 2,526,362 | 10/1950 | Johnston | 225/103 X |
| 2,818,701 | 1/1958 | Erkkila | 29/239 X |
| 3,993,220 | 11/1976 | Troy . | |
| 4,026,262 | 5/1977 | Yasuga | 225/96.5 X |
| 4,171,055 | 10/1979 | Lindgren . | |
| 4,248,564 | 2/1981 | Gentile et al. . | |
| 4,378,624 | 4/1983 | Klingenberg | 29/239 |
| 4,768,271 | 9/1988 | Jacob et al. . | |
| 4,805,821 | 2/1989 | Kowalczyk et al. | 225/96.5 |
| 4,817,810 | 4/1989 | Shull . | |
| 5,031,485 | 7/1991 | Wu . | |
| 5,295,419 | 3/1994 | Denning | 81/3.37 |

FOREIGN PATENT DOCUMENTS

| | | | |
|---|---|---|---|
| 3639617 | 6/1988 | Germany | 29/239 |

*Primary Examiner*—Rinaldi I. Rada
*Attorney, Agent, or Firm*—Daniel V. Thompson

[57] ABSTRACT

An ink cartridge opener is used connection with a flat support surface. The ink cartridge opener includes a base stand adapted to hold a first portion of a ink cartridge. An opening mechanism with the base stand applies sideways force to another portion of the ink cartridge in order to open the cartridge.

10 Claims, 4 Drawing Sheets

INK CARTRIDGE OPENER

FIELD OF INVENTION

The present invention relates to office supplies, and more particularly to a manufactured product designed to separate the parts of an ink cartridge for a computer printer.

BACKGROUND ART

Computer printers use a number of different techniques for applying ink to the paper. Many printers use a conventional typewriter ribbon, while other printers use thermal heads, and still others use lasers. One common species of computer printer uses ink jets, and the present invention is directed to a device for efficiently utilizing ink jet printers.

While ink jet printers have many advantages, one significant disadvantage is that the print head and ink reservoir are typically contained in a single disposable unit. For example, Hewlett-Packard of Vancouver, Wash., U.S.A. manufactures a line of ink jet printers that have disposable combination print head/ink reservoir cartridges. While the cartridges are of excellent quality, the requirement that a print head be supplied with each cartridge makes the cartridges unduly expensive. The useful life of a print head is many times the length of printing time provided by the ink reservoir, and thus a significant waste is incurred every time a spent cartridge is replaced simply because the ink has run out.

In addition, there are multicolor print cartridges that have three primary colors in separate reservoirs in each cartridge. Since it is rare that all three colors will simultaneously be spent, it is not unusual to throw away perfectly good cartridges having substantial supplies of two colors, but being empty for the third color.

For whatever reason, the manufacturers of the combination print head/ink reservoir cartridges have not seen fit to provide a way for the user to replenish the ink within the cartridges. In fact, the cartridges as presently supplied by, for example, Hewlett-Packard, have sonically welded cartridge halves that cannot be easily separated to enable reassembly after refilling one or more of the ink reservoirs inside.

Thus, there presently exists a need for a device to enable the separation of housing parts for an ink jet printer cartridge, such that internal ink reservoirs may be replenished and the cartridge reassembled for renewed use.

SUMMARY OF THE INVENTION

The present invention is a tool that enables the opening of an ink cartridge for refilling. In preferred form, one portion of the cartridge is firmly held in a base, while force is applied in a sideways direction to the other section of the cartridge. Preferably force is applied in such a way that the cartridge can be reassembled and reused after internal ink reservoirs have been refilled.

BRIEF DESCRIPTION OF THE DRAWINGS

A more complete understanding of the invention and its advantages will be apparent from the Detailed Description taken in conjunction with the accompanying Drawings in which.

DETAILED DESCRIPTION

Referring initially to FIGS. 1–7, where like numeral indicate like and corresponding elements, ink cartridge opener 10 is adapted for use in connection with a flat support surface, not shown. The flat support surface can be, for example, a desk top. In the preferred embodiment, opener has two components, a base stand 12 and a lever arm 14. As will be explained below, however, in connection with FIGS. 11 and 12, the preferred embodiment described herein is not the only manner in which the advantages of the present invention can be achieved.

Base stand 12 has substantially-coplanar, inner and outer bottom surfaces 16, 18. Surfaces 16, 18 are adapted for engagement with the support surface and are sufficiently long and wide to enable stable positioning of base stand 12 on the support surface.

Figure 5:
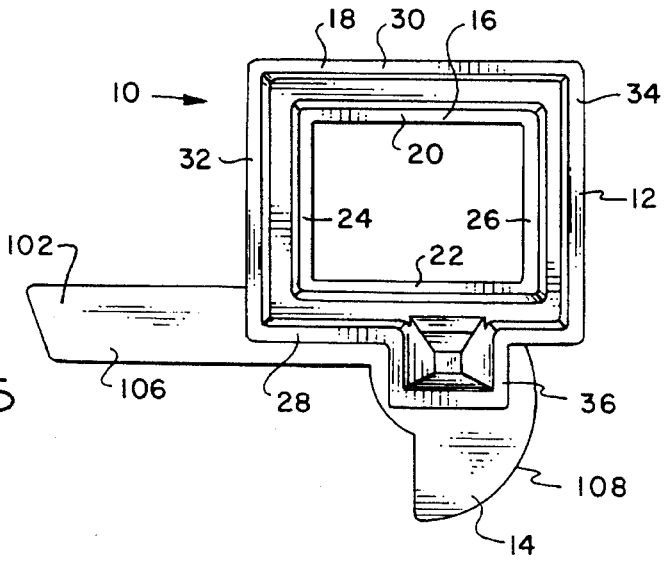
FIG. 5 is a bottom view of the device of FIG. 1.
Figure 6:
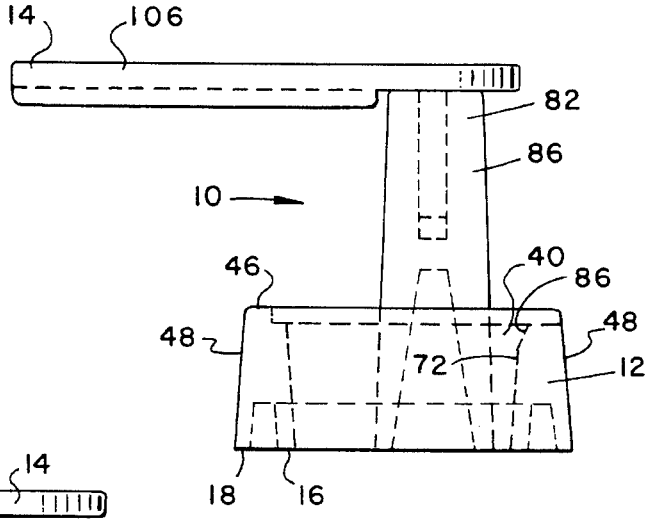
FIG. 6 is a side view of the device of FIG. 1 rotated 180 degrees from the view of FIG. 3.

As best shown in FIG. 5, inner bottom surface has two long sides 20, 22 and two short sides 24, 26 joined at right angles. Inner bottom surface 16 is thus open, rectangular and elongate.

Similarly, outer bottom surface 18 (FIG. 5) has first and second long sides 28, 30 and two short sides 32, 34. Long sides 28, 30 and short sides 32, 34 are also joined at right angles, but first side 28 has an outward U-shaped projection 36, such that outer bottom surface 18 is open, substantially rectangular and elongate, with a U-shaped projection from 36 from the first long side 28.

The base stand 12 has four slightly inwardly-sloped side walls 38, 40, 42, 44. Side walls 38–44 extend upwardly from the outer bottom surface 18 to a planar top surface 46. Adjacent side walls 38–40, 40–42, 42–44 and 44–38 are joined at sloping edges 48 to one another.

Figure 1:
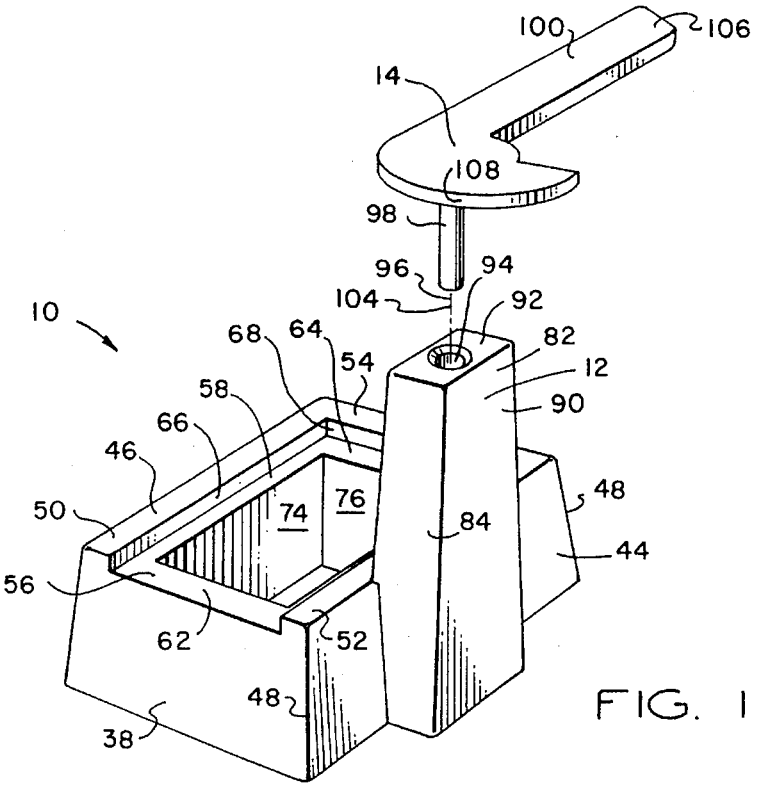
FIG. 1 is a perspective, exploded view of the preferred embodiment of the present invention.

Top surface 46 is parallel to bottom surfaces 16, 18. Top surface 46 is substantially U-shaped, as best shown in FIG. 1, with two side portions 50, 52 connected by a middle portion 54. Top surface side portions 50, 52 are long in the same direction as bottom surface long walls 20, 22, 28, 30. Top surface middle portion 54 is long in the direction of bottom surface side walls 12, 26.

Figure 2:
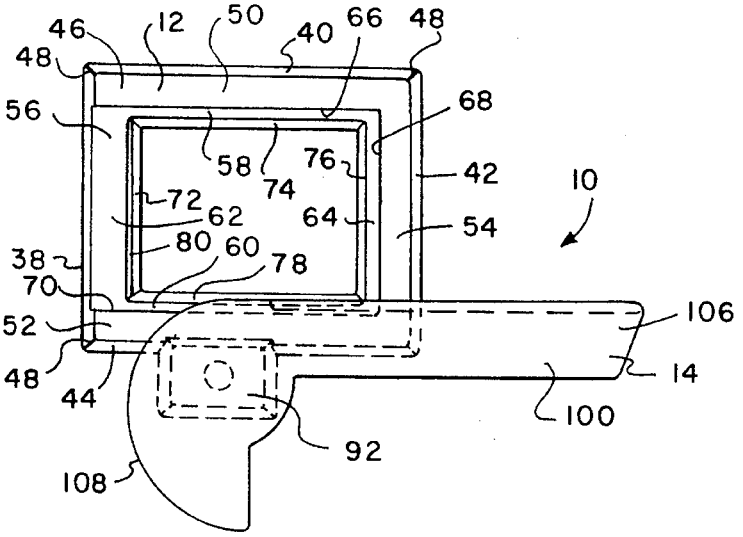
FIG. 2 is a top view of the device of FIG. 1.
Figure 3:
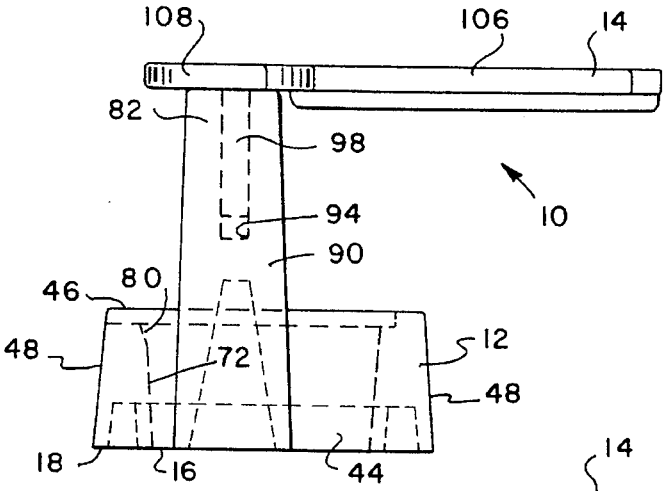
FIG. 3 is a side view of the device of FIG. 1.
Figure 4:
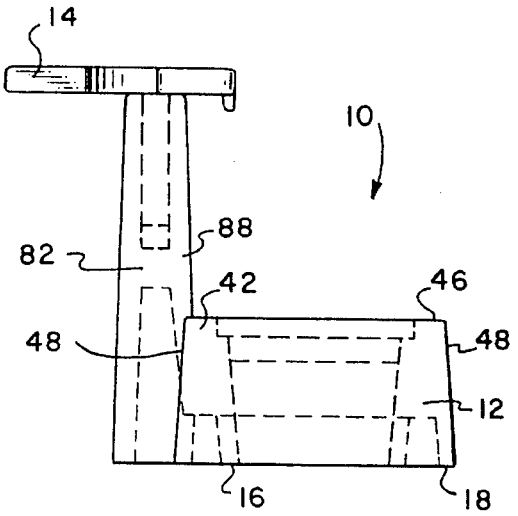
FIG. 4 is an end view of the device of FIG. 1.
Figure 7:
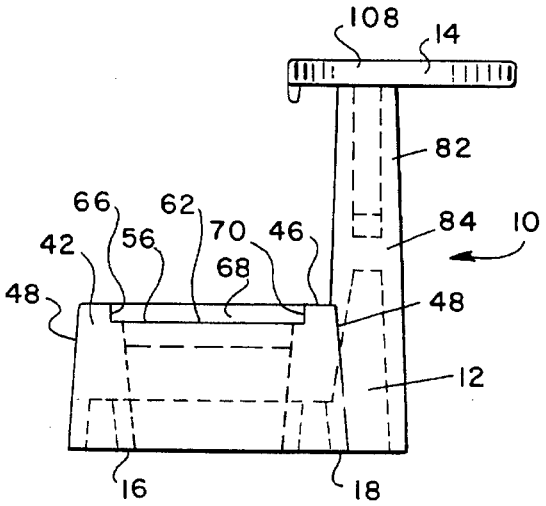
FIG. 7 is another end view of the device of FIG. 1 rotated 180 degrees from the view of FIG. 4.

Base stand 12 further includes a planar intermediate surface 56, as best shown in FIGS. 1, 2 and 7. Intermediate surface 56 is parallel to the bottom and top surfaces 16, 18, 46. Intermediate surface 56 has two long sides 58, 60 and two short sides 62, 64 joined at right angles. Intermediate surface 56 is open, rectangular and elongate with the top surface 46 and the intermediate surface 56 being joined by three short walls 66, 68, 70 extending therebetween. Intermediate surface short side 62 is wider than the other short side 64, and wider short side 62 is the only side of intermediate surface 56 that is not connected to a short wall 66, 68 or 70.

Base stand 12 further includes inner surfaces 72, 74, 76, 78. Inner surface 72–78 extend downwardly from intermediate surface 56 to the inner bottom surface 16. Inner surfaces 72–78 are slightly inwardly-sloped. Inner surface 72, which extends from wider intermediate surface short side 62, has an angled interface portion 80.

A pivot tower 82 extends upwardly from the U-shaped projection 36 of the outer bottom surface 18 and base stand side wall 44. Pivot tower 82 has four slightly inwardly sloped walls 84, 86, 88, 90. Walls 84–90 are joined at right angles, such that the tower is rectangular in cross-sections parallel to the bottom surfaces 16, 18. Tower walls 84–90 terminate at a top surface 92, with the top surface being planar and parallel to bottom surfaces 16, 18.

Pivot tower 82 further includes an inner cylindrical surface 94 (FIGS. 1 and 3) extending downwardly from the center of the pivot tower top surface 92. Cylindrical surface 94 has a central axis 96 perpendicular to bottom surfaces 16, 18.

Lever arm 14 has a pivot shaft 98 rotatably-engaged with cylindrical surface 94 of pivot tower 82. Arm 14 has coplanar upper and lower surfaces 100, 102 parallel to the base stand bottom surfaces 16, 18. Pivot shaft 98 extends from lever arm lower surface 100. Pivot shaft 98 is cylindrical about a central axis 104 collinear with the pivot tower's central axis 96. Lever arm 14 has a handle 106 on one side, and an eccentric surface 108 formed on the other side of lever arm 14.

Figure 8:
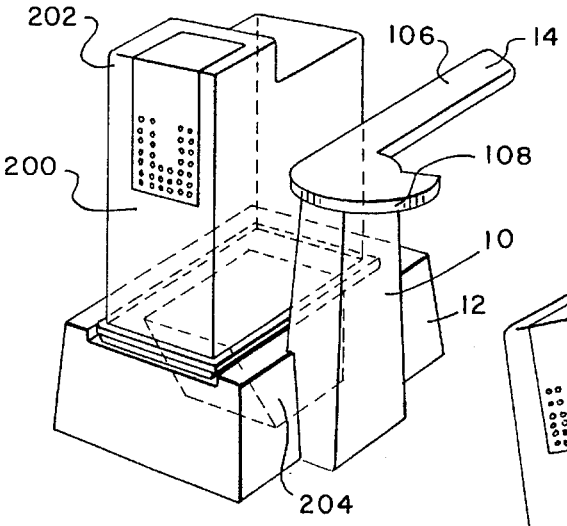
FIGS. 8 and 9 are views showing the device of the present invention in operation.
Figure 9:
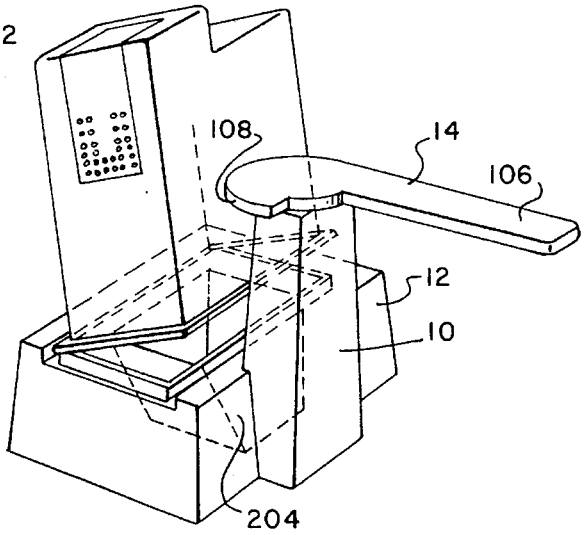

In operation, as best shown in FIGS. 8 and 9, an ink cartridge 200, such as a Hewlett-Packard 51625A color print cartridge, is inserted top down into base unit 12. The combination of surfaces is adapted to snugly hold cartridge 200, particularly in resistance to a sideways force. Handle 14 is inserted into pivot tower 82, as shown in FIG. 1. Eccentric surface 108 comes close but does not contact cartridge 200 in the configuration shown in FIG. 8. In contrast, when handle 106 is rotated to the position shown in FIG. 9, eccentric surface 108 is located more distantly from the central axis than in the position shown in FIG. 8. Thusly, a force is applied to the bottom section 202 of cartridge 200, while the top section 204 remains firmly engaged in base unit 12. This precise combination of forces is designed to cleanly break the sonic weld between top and bottom portions 202, 204. Refilling of the reservoirs inside bottom portion 202 can then be accomplished.

Figure 10:
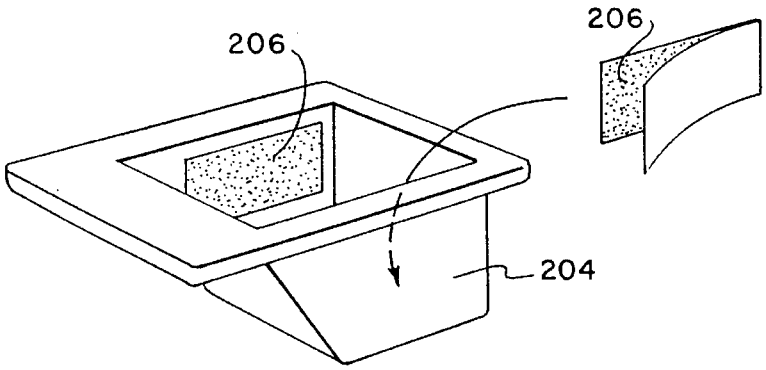
FIG. 10 illustrates the use of adhesive tape to reassemble the ink cartridge.

Referring now to FIG. 10, it has been found that with certain Hewlett-Packard ink cartridges it is desirable to place two pieces of adhesive tape 206 on opposite sides of the inside of upper portion 204. Bottom portion 202 has fingers built in which reach up and contact the adhesive tape 206, thereby retaining upper portion 204 firmly in place.

As described above, the preferred embodiment includes a rotating eccentric circle applied by leverage force to separate the upper and lower portions of a print cartridge. The top portion 204 of the cartridge is held fixed by stand 12, while lower portion 202 is gradually pushed sideways by lever arm 14. The eccentric circle surface 108 produces a very large force when the handle 14 is pulled by hand. This force eventually breaks the ultrasonic weld between the two parts of the ink cartridge.

Figure 11:
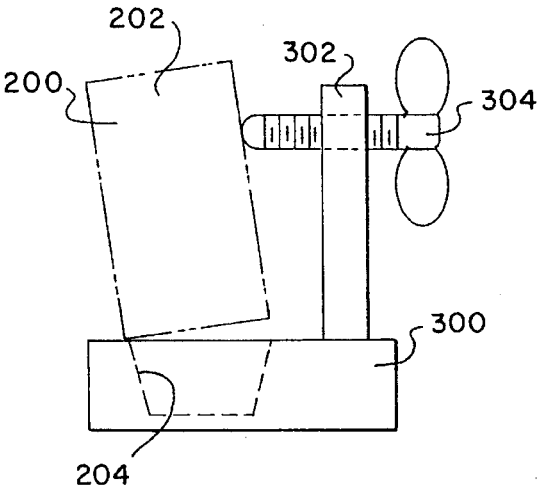
FIGS. 11 and 12 are schematics showing alternate forms of the invention.
Figure 12:
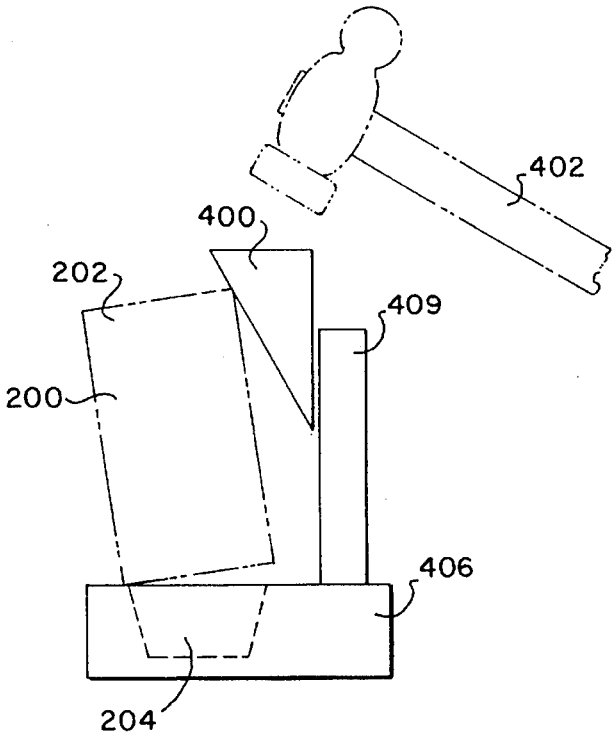

While the preferred embodiment operates in this fashion, it will be apparent that other equivalent means of accomplishing the same result are possible. For example, as shown in FIG. 11, a base 300 includes an arm 302 extending from one side. A thumb screw 304 is adapted to apply force to the lower portion 202 of cartridge 200, while interior walls in base 300 snugly hold upper portion 204. Similarly, as in FIG. 12, a wedge 400 could be used in conjunction with a hammer 402 to apply force between an arm 404 and the lower portion 202 of a cartridge 200. Again, walls in a base 406 hold the upper portion 204 of the cartridge. In both the alternate embodiments of FIGS. 11 and 12, a base snugly holds one portion of an ink cartridge, while means is provided to impart a sideways force on the other portion of the cartridge.

Whereas the present invention has been described with respect to specific embodiments thereof, it will be understood that various changes and modifications will be suggested to one skilled in the art, and it is intended to encompass such changes and modifications as fall within the scope of the appended claims.

I claim:

1. An ink cartridge opener for use in connection with a flat support surface, comprising:

a base stand having a substantially-coplanar inner and outer bottom surfaces adapted for engagement with the support surface;

the inner bottom surface having two long sides and two short sides joined at right angles, such that the inner bottom surface is open, rectangular and elongate;

the outer bottom surface having first and second long sides and two short sides joined at right angles, the first long side having an outward U-shaped projection, such that the outer bottom surface is open, substantially rectangular and elongate with a U-shaped projection from the first long side;

the base stand having four slightly inwardly-sloped side walls extending upwardly from the outer bottom surface to a planar top surface, with adjacent side walls being joined at sloping edges to one another;

the top surface being parallel to the bottom surfaces and substantially U-shaped, with two side portions connected by a middle portion;

the top surface side portions being long in the same direction as the bottom surface long walls and the top surface middle portion being long in the direction of the bottom surface side walls;

the base stand further including a planar intermediate surface parallel to the top and bottom surfaces, the intermediate surface having two long sides and two short sides joined at right angles, such that the intermediate surface is open, rectangular and elongate, with the top and intermediate surfaces being joined by three, short walls extending therebetween, with one the intermediate surface short sides being wider than the other and not connected to the top surface;

the base stand further including four inner surfaces extending downwardly from the intermediate surface to the inner bottom surface, the inner surfaces being slightly inwardly-sloped, with an inner surface extending from the wider intermediate surface short side having an angled interface portion;

a pivot tower extending upwardly from the U-shaped projection of the outer bottom surface and outwardly from one of the base stand side walls, the pivot tower having four slightly inwardly sloped walls, joined at right angles, such that the tower is rectangular in cross-sections parallel to the bottom surfaces, and the tower walls terminating at a top surface, the top surface being planar and parallel to the bottom surfaces;

the pivot tower further including an inner cylindrical surface extending downwardly from the center of the pivot tower top surface, the cylindrical surface having a central axis perpendicular to the bottom surfaces; and a lever arm having a pivot shaft rotatably-engaged with the cylindrical surface of the pivot tower, the arm having coplanar upper and lower surfaces parallel to the base stand bottom surfaces with the pivot shaft extending from the lever arm lower surface, the pivot shaft being cylindrical about a central axis collinear with the pivot tower central axis, and the lever arm having a handle extending outwardly from the lever arm central axis on one side of the lever arm, and an eccentric surface being formed on the other side of the lever arm.

2. An ink cartridge opener for use in connection with a flat support surface, comprising:

a base stand adapted to hold a first portion of an ink cartridge;

a lever arm pivotally connected to the base stand;

the lever arm having an eccentric surface for applying force to the ink cartridge as the lever arm is rotated;

a substantially-planar bottom surface adapted for engagement with the support surface; and the bottom surface having first and second long sides and two short sides joined at right angles, the first long side having an outward U-shaped projection, such that the bottom surface is open, substantially rectangular and elongate with a U-shaped projection from the first long side.

3. The ink cartridge opener of claim 2 with a pivot tower extending upwardly from the U-shaped projection of the bottom surface and outwardly from one of a plurality of base stand side walls.

4. The ink cartridge opener of claim 3 with the pivot tower having four slightly inwardly sloped walls, joined at right angles, such that the tower is rectangular in cross-sections parallel to the bottom surface.

5. The ink cartridge opener of claim 3 with the pivot tower having a top surface, the top surface being planar and parallel to the bottom surface, and the pivot tower further including an inner cylindrical surface extending downwardly from the center of the pivot tower top surface, the cylindrical surface having a central axis perpendicular to the bottom surface.

6. The ink cartridge opener of claim 5 with the lever arm having a pivot shaft rotatably-engaged with the cylindrical surface of the pivot tower, the arm having coplanar upper and lower surfaces parallel to the base stand bottom surfaces with the pivot shaft extending from the lever arm lower surface, the pivot shaft being cylindrical about a central axis collinear with the pivot tower central axis, and the lever arm having a handle extending outwardly from a lever arm central axis on one end of the lever arm, and an eccentric surface being formed on the other end of the lever arm.

7. An ink cartridge opener for use in connection with a flat support surface, comprising:

a base stand adapted to hold a first portion of an ink cartridge;

a lever arm pivotally connected to the base stand;

the lever arm having an eccentric surface for applying force to the ink cartridge as the lever arm is rotated;

a substantially-planar bottom surface adapted for engagement with the support surface;

with the bottom surface having two long sides and two short sides joined at right angles, such that the bottom surface is open, rectangular and elongate; and with the base stand having four slightly inwardly-sloped side walls extending upwardly from the bottom surface to a planar top surface, with adjacent side walls being joined at sloping edges to one another.

8. An ink cartridge opener for use in connection with a flat support surface, comprising:

a base stand adapted to hold a first portion of an ink cartridge;

a lever arm pivotally connected to the base stand;

the lever arm having an eccentric surface for applying force to the ink cartridge as the lever arm is rotated;

a substantially-planar bottom surface adapted for engagement with the support surface; and with the base stand having a top surface being parallel to the bottom surface and substantially U-shaped, the substantially U-shaped top surface being formed by two side portions connected by a middle portion.

9. The ink cartridge opener of claim 8 with the base stand further including a planar intermediate surface parallel to the top and bottom surfaces, the intermediate surface having two long sides and two short sides joined at right angles, such that the intermediate surface is open, rectangular and elongate, with the top and intermediate surfaces being joined by three, short walls extending therebetween, with one of the intermediate surface short sides being wider than the other and not connected to the top surface.

10. An ink cartridge opener for use in connection with a flat support surface comprising:

a base stand adapted to hold a first portion of an ink cartridge;

a lever arm pivotally connected to the base stand;

the lever arm having an eccentric surface for applying force to the ink cartridge as the lever arm is rotated;

a substantially-planar bottom surface adapted for engagement with the support surface; and with the base stand further including four inner surfaces extending downwardly from an intermediate surface to the bottom surface, the inner surfaces being slightly inwardly-sloped, with an inner surface extending from the wider intermediate surface short side having an angled interface portion.

* * * * *